US010959460B2

(12) United States Patent
Qiu

(10) Patent No.: US 10,959,460 B2
(45) Date of Patent: Mar. 30, 2021

(54) CIGARETTE CARTRIDGE AND ELECTRONIC CIGARETTE HAVING THE SAME

(71) Applicant: CHANGZHOU JWEI INTELLIGENT TECHNOLOGY CO., LTD., Jiangsu (CN)

(72) Inventor: Weihua Qiu, Jiangsu (CN)

(73) Assignee: CHANGZHOU JWEI INTELLIGENT TECHNOLOGY CO., LTD., Jiangsu (CN)

( * ) Notice: Subject to any disclaimer, the term of this patent is extended or adjusted under 35 U.S.C. 154(b) by 267 days.

(21) Appl. No.: 16/151,510

(22) Filed: Oct. 4, 2018

(65) Prior Publication Data

US 2019/0029326 A1 Jan. 31, 2019

Related U.S. Application Data

(63) Continuation-in-part of application No. PCT/CN2017/078800, filed on Mar. 30, 2017.

(30) Foreign Application Priority Data

Apr. 5, 2016 (CN) ..... 201620272810.7

(51) Int. Cl.
*A24F 47/00* (2020.01)

(52) U.S. Cl.
CPC ..... *A24F 47/008* (2013.01)

(58) Field of Classification Search
CPC ..... A24F 40/10; A24F 40/40; A24F 40/485; A24F 47/008
See application file for complete search history.

(56) References Cited

U.S. PATENT DOCUMENTS

| | | | | |
|---|---|---|---|---|
| 2013/0192623 | A1* | 8/2013 | Tucker | H01C 17/00 131/329 |
| 2016/0262455 | A1* | 9/2016 | Chen | A24F 47/008 |
| 2016/0366938 | A1* | 12/2016 | Wu | A24F 47/008 |
| 2018/0098575 | A1* | 4/2018 | Liu | H05B 3/44 |

FOREIGN PATENT DOCUMENTS

| | | | |
|---|---|---|---|
| CN | 203040683 | U | 7/2013 |
| CN | 203435687 | U | 2/2014 |
| CN | 104055223 | A | 9/2014 |
| CN | 204132390 | U | 2/2015 |
| CN | 104382237 | A | 3/2015 |
| CN | 205695704 | U | 11/2016 |
| EP | 2949226 | A1 | 12/2015 |

* cited by examiner

*Primary Examiner* — Eric Yaary
(74) *Attorney, Agent, or Firm* — Novick, Kim & Lee, PLLC; Allen Xue

(57) ABSTRACT

A cigarette cartridge, used in electronic cigarette, includes a cigarette cartridge, an atomizing seat, and a liquid guiding member. The cigarette cartridge housing defines a liquid storage chamber therein, the liquid storage chamber forms a liquid intake hole for flowing the tobacco liquid. The atomizing seat includes an inserting portion, the liquid guiding member is positioned on the inserting portion, the inserting portion is movably received in the cigarette cartridge housing, when under an external force, the inserting portion moves relative to the liquid intake hole and reaches a first position, the inserting portion seals the liquid intake hole, the liquid guiding member is staggered from the liquid intake hole.

18 Claims, 6 Drawing Sheets

CIGARETTE CARTRIDGE AND ELECTRONIC CIGARETTE HAVING THE SAME

FIELD OF THE TECHNOLOGY

The present disclosure relates to a technical field of electronic cigarette, and more particularly, relates to a cigarette cartridge and an electronic cigarette having the cigarette cartridge.

BACKGROUND

The current electronic cigarette includes a cigarette cartridge and a power supplying assembly, the cigarette cartridge includes a liquid storage chamber, a liquid guiding member and a heater. The liquid guiding member guides the tobacco liquid in the liquid storage chamber to the heater, the heater is electrically driven to the heat up the tobacco liquid, causing the tobacco liquid to be atomized to supply the user.

However, because the liquid storage chamber fluidly communicates with outside via the liquid guiding member, therefore, a liquid leakage risk exists during the transportation of the cigarette cartridge or the electronic having the cigarette cartridge, or during the period when the cigarette cartridge or the electronic having the cigarette cartridge are not used for a long time. The cigarette cartridge or the electronic cigarette having the cigarette cartridge can be contaminated easily by environment.

SUMMARY

Accordingly, it is necessary to provide a cigarette cartridge which can effectively avoid a leakage of the tobacco liquid.

It is necessary to provide an electronic cigarette having the cigarette cartridge.

A cigarette cartridge, used in electronic cigarette, includes a cigarette cartridge, an atomizing seat, and a liquid guiding member. The cigarette cartridge housing defines a liquid storage chamber therein, the liquid storage chamber forms a liquid intake hole for flowing the tobacco liquid. The atomizing seat includes an inserting portion, the liquid guiding member is positioned on the inserting portion, the inserting portion is movably received in the cigarette cartridge housing, when under an external force, the inserting portion moves relative to the liquid intake hole and reaches a first position, the inserting portion seals the liquid intake hole, the liquid guiding member is staggered from the liquid intake hole.

According to an embodiment, when under an external force, the inserting portion moves relative to the liquid intake hole and reaches a second position different from the first position, the liquid guiding member extends into the liquid intake hole and fluidly communicates with the liquid storage chamber.

According to an embodiment, the cigarette cartridge housing includes two groups of sidewalls opposite to each other, two connecting walls, and two blocking protrusions, the two connecting walls are spaced from each other along a direction perpendicular to a longitudinal direction of the cigarette cartridge housing, and connects between two sidewalls opposite to each other along the longitudinal direction of the cigarette cartridge housing, the blocking protrusion protrudes from an inner surface of the sidewall facing the connecting wall, the two connecting protrusions, the corresponding two connecting walls and the corresponding two sidewalls cooperatively define two of the liquid storage chambers, the two connecting walls define a smog passage between the two liquid storage chambers, the number of the liquid intake holes is two, the liquid intake hole is a gap between the blocking protrusion and a terminal end of the corresponding connecting wall.

According to an embodiment, the inserting portion defines two mounting holes cutting through opposite sides of the inserting portion, the liquid guiding member passes through the mounting holes and fluidly communicates with the smog passage, when the inserting portion is received in the cigarette cartridge housing and moves to the first position, the inserting position is received between the blocking protrusions, and a upper end of the inserting portion resists terminal ends of the two connecting walls, the liquid guiding member is positioned beneath the two liquid intake holes, when the inserting portion continues to move from the first position to the second position, an upper end of the inserting portion resists the two connecting walls, the liquid guiding member moves to extend into the two liquid intake holes on opposite sides.

According to an embodiment, the atomizing seat further includes a seat, the inserting portion is positioned on the seat, the seat defines a plurality of anti-skid slots on an external wall surface of the seat, the cigarette cartridge housing forms a plurality of limiting protrusions protruding inwardly from the cigarette cartridge housing, the plurality of limiting protrusions latch with the plurality of anti-skid slots.

According to an embodiment, the seat defines an assembly groove and a wiring hole, the cigarette cartridge further includes a heater and an electrode contact member, the electrode contact member is received in the assembly groove, the heater winds the liquid guiding member and is electrically connected to the electrode contact member via a leading wire positioned in the wiring hole.

According to an embodiment, the seat defines an air intake hole cutting through a bottom of the seat, the air intake hole fluidly communicates between outside and the inserting portion.

According to an embodiment, the cigarette cartridge further includes an external cover and an internal cover, the external cover is positioned on the cigarette cartridge housing, the internal cover is positioned between the external cover and the cigarette cartridge housing, the internal cover defines a first smog outlet fluidly communicating with the smog passage, the external cover defines a second smog outlets fluidly communicating with the first smog outlet.

According to an embodiment, the external cover is provided with a hook, the cigarette cartridge housing is provided with a protrusion engaging the hook.

According to an embodiment, the atomizing seat is made of rubber r silica gel.

An electronic cigarette, includes a power supplying mechanism and a cigarette cartridge as mentioned above, wherein the cigarette cartridge is detachably connected to the power supplying mechanism.

According to an embodiment, the power supplying mechanism includes a battery housing having a receiving chamber, the battery housing is provided with a latching tab protruding from an inner wall surface of the battery housing, the cigarette cartridge defines a latching groove on a position corresponding to the latching tab, the cigarette cartridge is detachably received in the receiving chamber via the latching tab and the latching groove.

According to an embodiment, the power supplying mechanism further includes a power supplying assembly received in the receiving chamber, the cigarette cartridge is electrically connected to the power supplying assembly.

According to an embodiment, when under an external force, the inserting portion moves relative to the liquid intake hole and reaches a second position different from the first position, the liquid guiding member extends into the liquid intake hole and fluidly communicates with the liquid storage chamber.

According to an embodiment, the cigarette cartridge housing comprises two groups of sidewalls opposite to each other, two connecting walls, and two blocking protrusions, the two connecting walls are spaced from each other along a direction perpendicular to a longitudinal direction of the cigarette cartridge housing, and connects between two sidewalls opposite to each other along the longitudinal direction of the cigarette cartridge housing, the blocking protrusion protrudes from an inner surface of the sidewall facing the connecting wall, the two connecting protrusions, the corresponding two connecting walls and the corresponding two sidewalls cooperatively define two of the liquid storage chambers, the two connecting walls define a smog passage between the two liquid storage chambers, the number of the liquid intake holes is two, the liquid intake hole is a gap between the blocking protrusion and a terminal end of the corresponding connecting wall.

According to an embodiment, the inserting portion defines two mounting holes cutting through opposite sides of the inserting portion, the liquid guiding member passes through the mounting holes and fluidly communicates with the smog passage, when the inserting portion is received in the cigarette cartridge housing and moves to the first position, the inserting position is received between the blocking protrusions, and a upper end of the inserting portion resists terminal ends of the two connecting walls, the liquid guiding member is positioned beneath the two liquid intake holes, when the inserting portion continues to move from the first position to the second position, an upper end of the inserting portion resists the two connecting walls, the liquid guiding member moves to extend into the two liquid intake holes on opposite sides.

According to an embodiment, the atomizing seat further comprises a seat, the inserting portion is positioned on the seat, the seat defines a plurality of anti-skid slots on an external wall surface of the seat, the cigarette cartridge housing forms a plurality of limiting protrusions protruding inwardly from the cigarette cartridge housing, the plurality of limiting protrusions latch with the plurality of anti-skid slots.

According to an embodiment, the seat defines an assembly groove and a wiring hole, the cigarette cartridge further comprises a heater and an electrode contact member, the electrode contact member is received in the assembly groove, the heater winds the liquid guiding member and is electrically connected to the electrode contact member via a leading wire positioned in the wiring hole.

According to an embodiment, the seat defines an air intake hole cutting through a bottom of the seat, the air intake hole fluidly communicates between outside and the inserting portion.

According to an embodiment, the cigarette cartridge further includes an external cover and an internal cover, the external cover is positioned on the cigarette cartridge housing, the internal cover is positioned between the external cover and the cigarette cartridge housing, the internal cover defines a first smog outlet fluidly communicating with the smog passage, the external cover defines a second smog outlets fluidly communicating with the first smog outlet.

In the present disclosure, when the electronic cigarette in the present disclosure is not used, the inserting portion of the cigarette cartridge is pushed to the first position under the external force, the liquid guiding member is blocked between the blocking protrusions and is staggered from the liquid intake hole, the inserting portion blocks the liquid intake hole on the liquid storage chamber, causing the liquid guiding member not to contact the tobacco liquid in the liquid storage chamber, thereby effectively avoiding a liquid leakage during the transportation of the cigarette cartridge, or during a long unused period.

Figure 1:
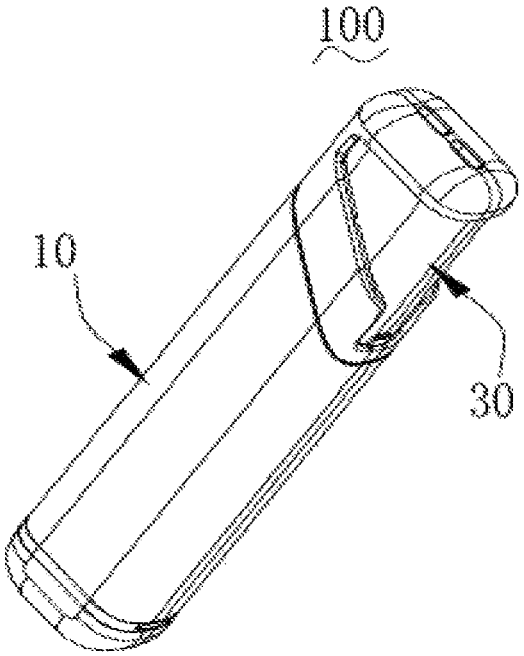
FIG. 1 is an schematic view of an electronic cigarette of the present disclosure.

| | |
|---|---|
| electronic cigarette 100 | power supplying mechanism 10 |
| receiving chamber 110 | latching tab 112 |
| cigarette cartridge 30 | cigarette cartridge housing 31 |
| latching groove 3101 | side wall 311 |
| connecting wall 312 | blocking protrusion 313 |
| a liquid storage chamber 314 | a liquid intake hole 315 |
| smog passage 316 | protrusion 317 |
| limiting protrusion 318 | atomizing seat 32 |
| seat 321 | assembly groove 3210 |
| wiring hole 3212 | air intake hole 3214 |
| anti-skid groove 3216 | inserting portion 323 |
| liquid guiding member 33 | heater 34 |
| electrode contact member 35 | external cover 36 |

DETAILED DESCRIPTION OF THE PREFERRED EMBODIMENT

Embodiments of the present disclosure are described more fully hereinafter with reference to the accompanying drawings. The various embodiments of the present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

It should be noted that when an element is described as "fastened to" or "disposed on" another element, the element may be directly on the another element, or a mediate element may also exist; when an element is described as "connected to" another element, the element may be directly connected to the another element, or a mediate element may also exist.

Unless otherwise defined, all terms used herein have the same meaning as commonly understood by one of ordinary skill in the art to which this present disclosure belongs. Terms in the description of the present disclosure are for the purpose of describing specific embodiments, and are not intend to limit the present disclosure. As used herein, the term "and/or" includes any and all combinations of one or more of the associated listed items.

Figure 2:
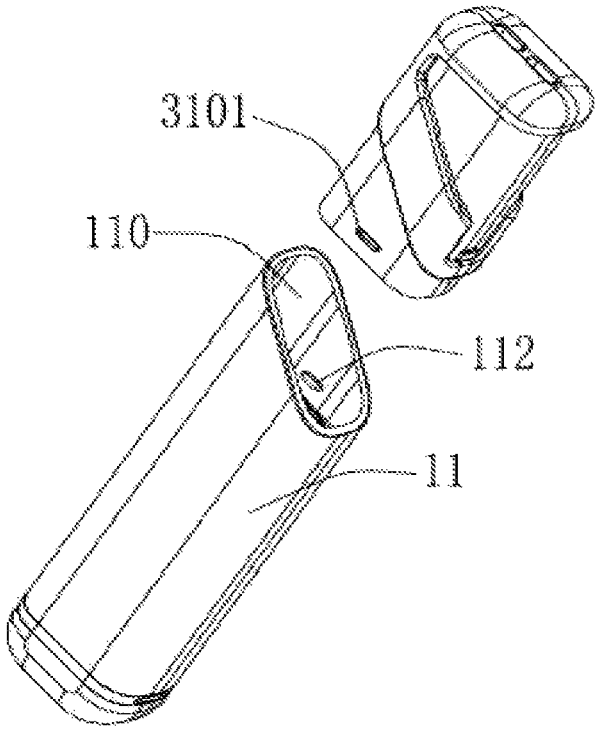
FIG. 2 is an exploded view of the electronic cigarette of FIG. 1.

Referring to FIG. 1 and FIG. 2, according to a preferred embodiment of the present disclosure, the electronic cigarette 100 includes a power supplying device 10, and a cigarette cartridge 30 configured for storing tobacco liquid. The power supplying device 10 includes a battery housing 11 and a power supplying assembly (not shown). The battery housing 11 defines a receiving chamber 110, the power supplying assembly is received in the receiving chamber 110. The cigarette cartridge 30 is detachably received in the receiving chamber 110 of the battery housing 11 and is electrically connected to the power supplying assembly, for heating up the tobacco liquid and atomizing the tobacco liquid. In the illustrated embodiment, the battery housing 11 is provided with a latching tab 112 protruding from an inner wall surface of the battery housing 11, the cigarette cartridge 30 defines a latching groove 3101 on a position corresponding to the latching tab 112. Therefore, the cigarette cartridge 30 is detachably connected to the power supplying device 10 via the latching groove 3101 and the latching tab 112. It can be understood that, in alternative embodiments, the matching structures of the power supplying device 10 and the cigarette cartridge 30 can be determined according to a requirement, merely permitting the power supplying device 10 to be detachably connected to the cigarette cartridge 30. For example, the matching structures can be two latching hooks latching with each other, which are not limited hereby.

Figure 3:
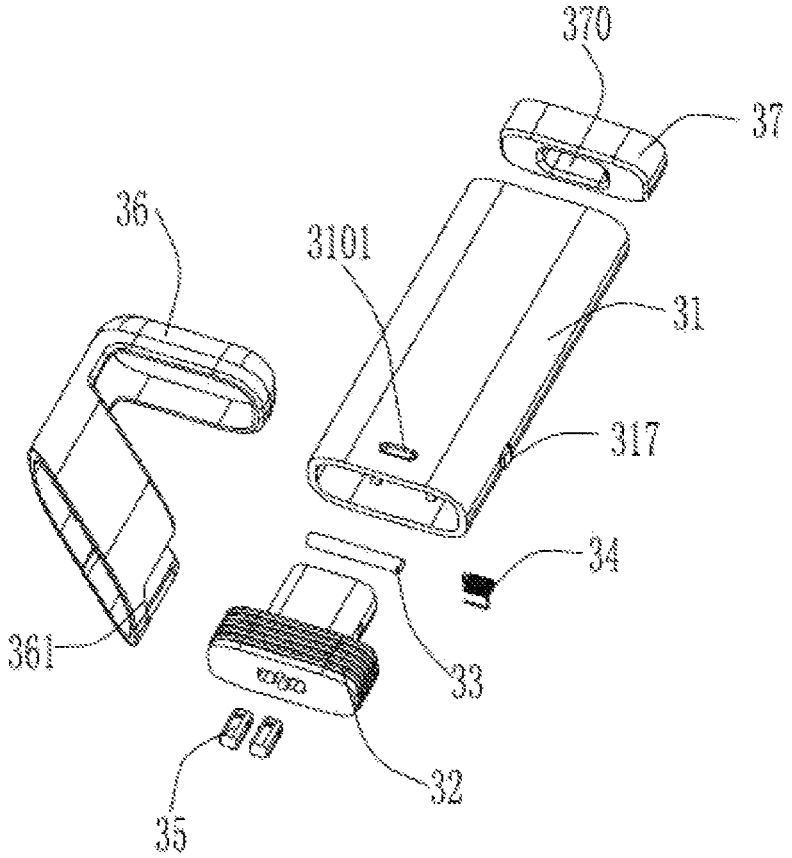
FIG. 3 is an exploded view of a cigarette cartridge of the electronic cigarette of FIG. 1.
Figure 4:
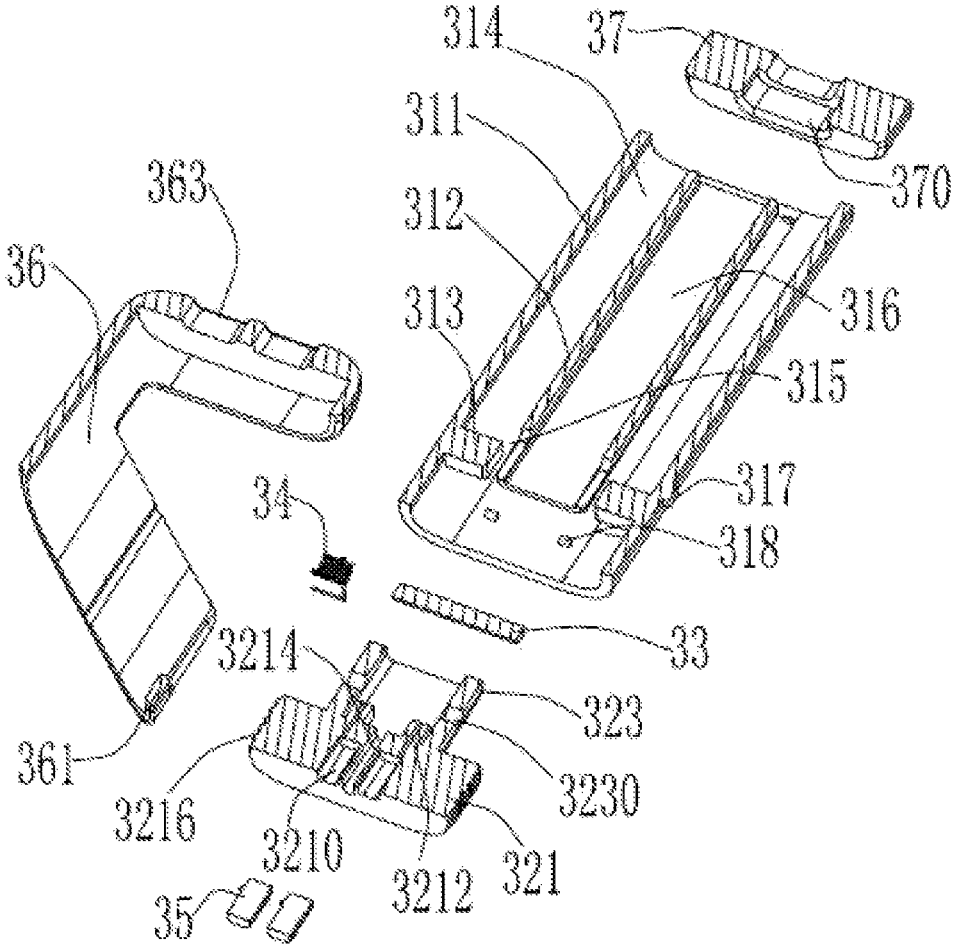
FIG. 4 is a cross-sectional view of the cigarette cartridge of electronic cigarette of FIG. 3.
Figure 5:
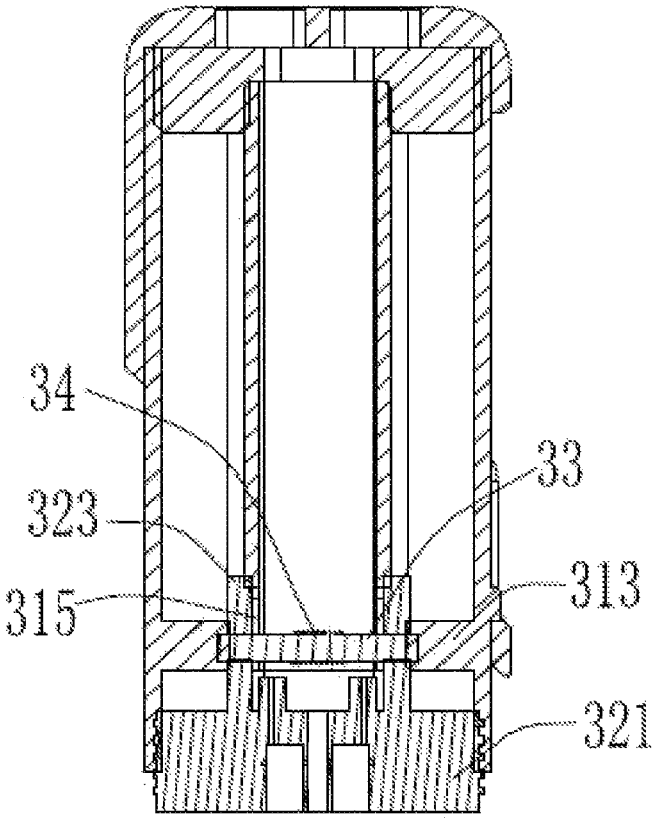
FIG. 5 shows a first using state of the cigarette cartridge of electronic cigarette of FIG. 3.
Figure 6:
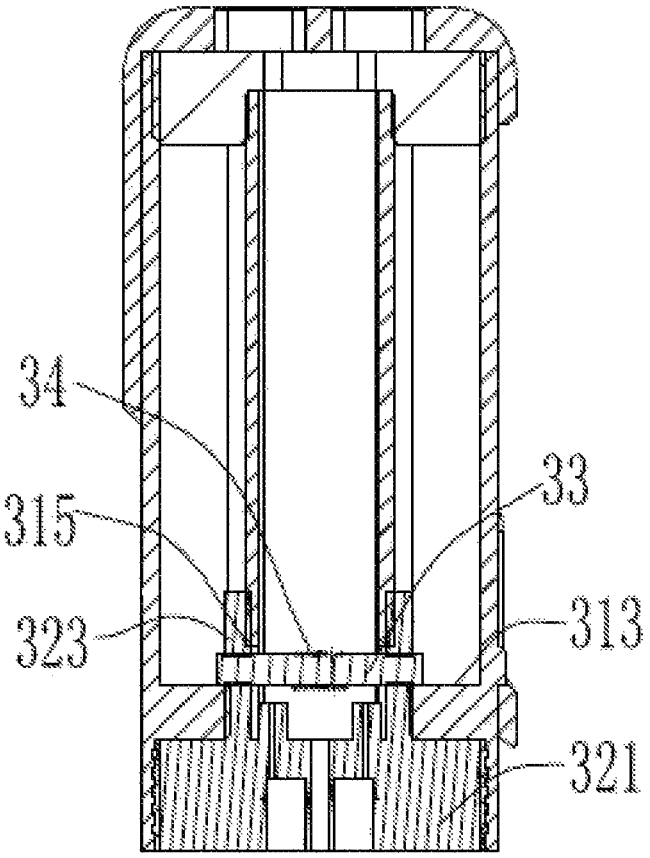
FIG. 6 shows a second using state of the cigarette cartridge of electronic cigarette of FIG. 3.

Also referring to FIG. 3 and FIG. 4, the cigarette cartridge 30 includes a cigarette cartridge housing 31, an atomizing seat 32, a liquid guiding member 33, a heater 34, and an electrode contact member 35. The latching groove 3101 is defined on an outer wall surface of the cigarette cartridge housing 31, configured to engage the latching tab 112 to accomplish a detachably connection between the cigarette cartridge housing 31 and the battery housing 11. The atomizing seat 32 is received in an end of the cigarette cartridge housing 31. The heater 34 winds the liquid guiding member 33, the heater 34 and the liquid guiding member 33 are positioned on the top of the atomizing seat 32. The electrode contact member 35 is positioned on a bottom of the atomizing seat 32, and is electrically connected between the power supplying assembly and the heater 34, enabling the heater 34 to be electrically driven to heat up and atomize the tobacco liquid which is guided to the heater 34 by the liquid guiding member 33.

Specifically, referring to FIG. 4, the cigarette cartridge housing 31 is a hollow rectangular pillar having two ends fluidly communicating with each other. The cigarette cartridge housing 31 includes two groups of sidewalls 311 corresponding to each other, two connecting walls 312 and two blocking protrusions 313. The connecting walls 312 connects with the two sidewalls 311 opposite to each other, and are arranged along a longitudinal direction of the cigarette cartridge housing 31. The blocking protrusion 313 protrudes from an inner surface of an end of the sidewall 311, and is adjacent to the atomizing seat 32 and faces the connecting wall 312. The connecting protrusion 312, the connecting wall 312 and the sidewall 311 cooperatively define a liquid storage chamber 314 for storing the tobacco liquid. The blocking protrusion 313 and the terminal end of the connecting wall 312 form a gap there-between for forming a liquid intake hole 315 fluidly communicating with the liquid storage chamber 314. In the illustrated embodiment, the number of the connecting walls 312 is two, the two connecting walls 312 are spaced from each other and arranged along a direction perpendicular to a longitudinal direction of the cigarette cartridge housing 31. Accordingly, the number of the blocking protrusions 313 is two, the number of the liquid intake hole 315 is two, each of the liquid intake hole 315 is a gap between the blocking protrusion 313 and the corresponding connecting wall 312. Therefore, the two blocking protrusions 313, the two connecting walls 312, the two sidewalls 311 cooperatively form two of the liquid storage chamber 314. The two connecting walls 312 define a smog passage 316 between the two liquid storage chambers 314. It can be understood that, in other alternative embodiments, the number of the liquid storage chambers 314 and the position of the smog passage 316 can be determined according to a requirement, at the same time, the liquid storage chamber 314 can be formed by the two connecting walls 312 and the blocking protrusions 313 which enclose the liquid storage chamber 314. Or the two sidewalls 311 on opposite sides of the cigarette cartridge housing 31 enclose to form the liquid storage chamber 314, merely forming a space storing the tobacco liquid, which is not limited hereby.

Further, the cigarette cartridge 30 further includes an external cover 36 and an internal cover 37, the external cover 36 is positioned on an end of the cigarette cartridge housing 31 away from the blocking protrusion 313. The internal cover 37 is positioned between the external cover 36 and the cigarette cartridge housing 31. Specifically, the external cover 36 is provided with a hook 361, the cigarette cartridge housing 31 is provided with a protrusion 317 on a position corresponding to the hook 361, for strengthening an engage between the external cover 36 and the cigarette cartridge housing 31, effectively avoiding a falling of the internal cover 37 between the external cover 36 from the cigarette cartridge housing 31.

Further, the internal cover 37 defines a first smog outlet 370 fluidly communicating with the smog passage 316, the external cover 36 defines two second smog outlets 363 (as shown in FIG. 4) fluidly communicating with the first smog outlet 370, the smog atomized by the heater 34 flows out via the first smog outlet 370 and the second smog outlet 363.

The atomizing seat 32 substantially has a T shape, and is movably received in the cigarette cartridge housing 31. Specifically, the atomizing seat 32 includes a seat 321, and an inserting portion 323 positioned on the seat 321.

The seat 321 defines an assembly groove 3210 and a wiring hole 3212, the assembly groove 3210 is positioned on a bottom of the seat 321 and cuts through the bottom of the seat 321, the electrode contact member 35 is received in the assembly groove 3210 and is electrically connected to the power supplying assembly of the power supplying device 10, for providing an atomizing power source for the heater 34. The wiring hole 3212 is positioned on an end of the assembly groove 3210 adjacent to the inserting portion 323, and fluidly communicates with the assembly groove 3210, for receiving the leading wires which are electrically connected to the electrode contact member 35 and the heater 34.

The inserting portion 323 is movably inserted into the cigarette cartridge housing 31, the heater 34 winds the liquid guiding member 33, the heater 34 together with the liquid guiding member 33 are positioned on the inserting portion 323. Specifically, when the inserting portion 323 is inserted into the cigarette cartridge housing 31, under an external force, the inserting portion 323 moves relative to the liquid intake hole 315 and reaches the first position, the inserting portion 323 seals the liquid intake hole 315, the liquid guiding member 33 is staggered from the liquid intake hole 315. When the inserting portion 323 is inserted into the cigarette cartridge housing 31, under an external force, the inserting portion 323 moves relative to the liquid intake hole 315 and reaches the second position, the liquid guiding member 33 is latched into the liquid intake hole 315 and fluidly communicates with the liquid storage chamber 314.

In the illustrated embodiment, the inserting portion 323 is a hollow rectangular pillar, and perpendicularly extends outwardly from a side of the seat 321. The inserting portion 323 defines two mounting holes 3230, the two mounting holes 3230 cut through the inserting portion 323, and are arranged along a direction parallel to the seat 321. The liquid guiding member 33 laterally passes through the mounting holes 3230. The heater 34 winds the liquid guiding member 33 and is electrically connected to the electrode contact member 35 via the leading wire positioned in the wiring hole 3212, for heating up and atomizing the tobacco liquid guided by the liquid guiding member 33.

Further, the seat 321 defines an air intake hole 3214 cutting through the bottom of the seat 321, the air intake hole 3214 fluidly communicates between outside and the inserting portion 323, providing atomized airflow for the heater 34 in the inserting portion 323.

Further, the seat 321 defines a plurality of anti-skid slots 3216 on an external wall surface of the seat 321. The cigarette cartridge housing 31 forms a plurality of limiting protrusions 318 protruding inwardly from the cigarette cartridge housing 31. The plurality of limiting protrusions 318 latches with the plurality of anti-skid slots 3216, for securing the atomizing seat 32 to the cigarette cartridge housing 31 when the atomizing seat 32 is received in the cigarette cartridge housing 31.

In the illustrated embodiment, the atomizing seat 32 is made of material having an elastic deformation capacity, such as rubber or silica gel. Therefore, under an external force, the anti-skid slots 3216 detach from the limiting protrusions 318, the upper end of the inserting portion 323 is deformed by a force, and slides into the liquid storage chamber 314 via the liquid intake holes 315, and moves forward, thereby causing the inserting portion move to the second position from the first position. At the same time, the liquid guiding member 33 is made of porous material, for guiding and absorbing the tobacco liquid in the liquid storage chamber 314.

When the electronic cigarette 100 is not used, the inserting portion 323 is inserted between the blocking protrusions 313, and the upper end of the inserting portion 323 resists the terminal end of the two connecting walls 312, at the time, the inserting portion 323 blocks the liquid intake holes 315 on the liquid storage chamber 314, the liquid guiding member 33 is positioned beneath the two liquid intake holes 315 and cannot contact the tobacco liquid in the liquid storage chamber 314 (i.e. the first position mentioned above). At the same time, the seat 321 engages the limiting protrusion 318 via the anti-skid slot 3216, causing the atomizing seat 32 not to be pulled from the cigarette cartridge housing 31. When using the electronic cigarette 100, the atomizing seat 32 is further pushed for continuing moving the inserting portion 323 from the first position to the second position. Because the atomizing seat 32 possesses a certain amount of elasticity, the upper end of the inserting portion 323 resists the two connecting walls 312, causing the liquid guiding member 33 to continually move forward and extends into the two liquid intake holes 315 on opposite sides to contact the tobacco liquid in the liquid storage chamber 314. When the atomizing seat 32 is electrically connected to the power supplying assembly via the electrode contact member 35, the heater 34 heats up the tobacco liquid guided by the liquid guiding member 33, and causes the atomized liquid to be discharged from the first smog outlet 370 and the second smog outlet 363 via the smog passage 316.

When the electronic cigarette 100 in the present disclosure is not used, the inserting portion 323 of the cigarette cartridge 30 is pushed to the first position under the external force, the liquid guiding member 33 is blocked between the blocking protrusions 313 and is staggered from the liquid intake hole 315, the inserting portion 323 blocks the liquid intake hole 315 on the liquid storage chamber 314, causing the liquid guiding member 33 not to contact the tobacco liquid in the liquid storage chamber 314, thereby effectively avoiding a liquid leakage during the transportation of the cigarette cartridge 30, or during a long unused period.

The above are several embodiments of the present disclosure described in detail, and should not be deemed as limitations to the scope of the present disclosure. It should be noted that variations and improvements will become apparent to those skilled in the art to which the present disclosure pertains without departing from its spirit and scope. Therefore, the scope of the present disclosure is defined by the appended claims.

What is claimed is:

1. A cigarette cartridge, used in for an electronic cigarette, comprising:

a cigarette cartridge housing;

an atomizing seat comprising an inserting portion;

a liquid guiding member disposed on the inserting portion wherein the inserting portion is movably received in the cigarette cartridge housing, and is configured to move under an external force relative to the liquid intake hole to a first position, whereby the inserting portion seals the liquid intake hole and the liquid guiding member is staggered from the liquid intake hole, wherein the cigarette cartridge housing comprises: two sidewalls opposite to each other, two connecting walls, two blocking protrusions, and two liquid intake holes, wherein the two connecting walls are spaced apart from each other along a direction perpendicular to a longitudinal direction of the cigarette cartridge housing, and connect between two sidewalls opposite to each other along the longitudinal direction of the cigarette cartridge housing, wherein each of the two blocking protrusion protrudes from an inner surface of the sidewall facing the corresponding connecting wall, wherein the two blocking protrusions, the two connecting walls and the two sidewalls cooperatively define a liquid storage chamber, and wherein the two connecting walls define a smog passage, and each of the two liquid intake holes is a gap between one of the two blocking protrusions and a terminal end of the corresponding connecting wall.

2. The cigarette cartridge according to claim 1, wherein the inserting portion is configured to move under an external force relative to the liquid intake hole to a second position, and the liquid guiding member extends into the liquid intake hole and fluidly communicates with the liquid storage chamber.

3. The cigarette cartridge according to claim 1, wherein the inserting 1 portion defines two mounting holes cutting through opposite sides of the inserting portion, the liquid guiding member passes through the mounting holes and fluidly communicates with the smog passage, when the inserting portion is received in the cigarette cartridge housing and moves to the first position, the inserting position is received between the two blocking protrusions, and a upper end of the inserting portion resists terminal ends of the two connecting walls, the liquid guiding member is positioned beneath the two liquid intake holes, when the inserting portion continues to move from the first position to the second position, an upper end of the inserting portion resists the two connecting walls, the liquid guiding member moves to extend into the two liquid intake holes on opposite sides.

4. The cigarette cartridge according to claim 1, wherein the atomizing seat further comprises a seat, the inserting portion is positioned on the seat, the seat defines a plurality of anti-skid slots on an external wall surface of the seat, the cigarette cartridge housing forms a plurality of limiting protrusions protruding inwardly from the cigarette cartridge housing, the plurality of limiting protrusions latch with the plurality of anti-skid slots.

5. The cigarette cartridge according to claim 4, wherein the seat defines an assembly groove and a wiring hole, the cigarette cartridge further comprises a heater and an electrode contact member, the electrode contact member is received in the assembly groove, the heater winds the liquid guiding member and is electrically connected to the electrode contact member via a leading wire positioned in the wiring hole.

6. The cigarette cartridge according to claim 4, wherein the seat defines an air intake hole cutting extending through a bottom of the seat and fluidly communicates with the inserting portion.

7. The cigarette cartridge according to claim 1, wherein the cigarette cartridge further includes an external cover and an internal cover, the external cover is positioned on the cigarette cartridge housing, the internal cover is positioned between the external cover and the cigarette cartridge housing, the internal cover defines a first smog outlet fluidly communicating with the smog passage, the external cover defines a second smog outlets fluidly communicating with the first smog outlet.

8. The cigarette cartridge according to claim 7, wherein the external cover is provided with a hook, the cigarette cartridge housing is provided with a protrusion configured to engage the hook.

9. The cigarette cartridge according to claim 1, wherein the atomizing seat is made of rubber or silica gel.

10. An electronic cigarette, comprising a power supply and a cigarette cartridge according to claim 1, wherein the cigarette cartridge is detachably connected to the power supplying mechanism.

11. The electronic cigarette according to claim 1, wherein the power supply comprises a battery housing having a receiving chamber, the battery housing is provided with a latching tab protruding from an inner wall surface of the battery housing, the cigarette cartridge defines a latching groove on a position corresponding to the latching tab, the cigarette cartridge is detachably received in the receiving chamber via the latching tab and the latching groove.

12. The electronic cigarette according to claim 11, wherein the power supply further comprises a power supplying assembly received in the receiving chamber, the cigarette cartridge is electrically connected to the power supplying assembly.

13. The electronic cigarette according to claim 10, wherein the inserting portion is configured to move under an external force relative to the liquid intake hole to reach a second position, and the liquid guiding member extends into the liquid intake hole and fluidly communicates with the liquid storage chamber.

14. The electronic cigarette according to claim 1, wherein the inserting portion defines two mounting holes cutting through opposite sides of the inserting portion, the liquid guiding member passes through the mounting holes and fluidly communicates with the smog passage, when the inserting portion is received in the cigarette cartridge housing and moves to the first position, the inserting position is received between the blocking protrusions, and a upper end of the inserting portion resists terminal ends of the two connecting walls, the liquid guiding member is positioned beneath the two liquid intake holes, when the inserting portion continues to move from the first position to the second position, an upper end of the inserting portion resists the two connecting walls, the liquid guiding member moves to extend into the two liquid intake holes on opposite sides.

15. The electronic cigarette according to claim 10, wherein the atomizing seat further comprises a seat, the inserting portion is positioned on the seat, the seat defines a plurality of anti-skid slots on an external wall surface of the seat, the cigarette cartridge housing forms a plurality of limiting protrusions protruding inwardly from the cigarette cartridge housing, the plurality of limiting protrusions latch with the plurality of anti-skid slots.

16. The electronic cigarette according to claim 15, wherein the seat defines an assembly groove and a wiring hole, the cigarette cartridge further comprises a heater and an electrode contact member, the electrode contact member is received in the assembly groove, the heater winds the liquid guiding member and is electrically connected to the electrode contact member via a leading wire positioned in the wiring hole.

17. The electronic cigarette according to claim 15, wherein the seat defines an air intake hole extending through a bottom of the seat and fluidly communicates with the inserting portion.

18. The electronic cigarette according to claim 1, wherein the cigarette cartridge further includes an external cover and an internal cover, the external cover is positioned on the cigarette cartridge housing, the internal cover is positioned between the external cover and the cigarette cartridge housing, the internal cover defines a first smog outlet fluidly communicating with the smog passage, the external cover defines a second smog outlet fluidly communicating with the first smog outlet.

* * * * *